US006668511B2

(12) United States Patent
Xammar

(10) Patent No.: US 6,668,511 B2
(45) Date of Patent: Dec. 30, 2003

(54) FORMWORK FOR PILLARS

(75) Inventor: Pedro Bove Xammar, Montcada I ReiXach (ES)

(73) Assignee: Encofrados J. Alsina, S.A., Montcada I Reixach (ES)

( * ) Notice: Subject to any disclaimer, the term of this patent is extended or adjusted under 35 U.S.C. 154(b) by 0 days.

(21) Appl. No.: 09/975,199

(22) Filed: Oct. 12, 2001

(65) Prior Publication Data

US 2002/0066249 A1 Jun. 6, 2002

Related U.S. Application Data

(63) Continuation of application No. PCT/ES00/00130, filed on Apr. 12, 2000.

(30) Foreign Application Priority Data

Apr. 13, 1999 (ES) ..... 9900928 U

(51) Int. Cl.[7] ..... E04C 3/34

(52) U.S. Cl. ..... 52/721.1; 52/302.5; 52/721.2; 52/721.3; 52/726.2; 249/1; 249/13; 249/18; 249/48; 249/49; 249/170; 249/172; 249/192; 249/194; 249/210; 25/121

(58) Field of Search ..... 52/302.5, 721.1, 52/721.2, 726.2; 249/48, 49, 194, 219.1, 1, 13, 18, 170–172, 192, 193, 210; 25/121

(56) References Cited

U.S. PATENT DOCUMENTS

| | | | | | |
|---|---|---|---|---|---|
| 1,717,579 | A | * | 6/1929 | Pape | 249/48 |
| 1,871,919 | A | * | 8/1932 | Schubert | 249/48 |
| 2,595,286 | A | * | 5/1952 | Otte et al. | 249/48 |
| 3,021,586 | A | * | 2/1962 | Uruburu | 249/49 |
| 3,167,841 | A | * | 2/1965 | Wehr | 25/131 |
| 3,260,493 | A | * | 7/1966 | Beckham | 249/48 |
| 3,362,674 | A | * | 1/1968 | Gilbert | 249/49 |
| 3,795,393 | A | * | 3/1974 | Melfi | 269/116 |
| 4,003,543 | A | * | 1/1977 | Doubleday et al. | 249/48 |
| 4,708,315 | A | * | 11/1987 | Carlson et al. | 249/192 |
| 4,958,800 | A | * | 9/1990 | Carlson | 249/216 |

* cited by examiner

*Primary Examiner*—Carl D. Friedman
*Assistant Examiner*—Christy Green
(74) *Attorney, Agent, or Firm*—Sughrue Mion, PLLC

(57) ABSTRACT

It is constituted by several plates (1), provided in its outer side (4) with transverse ribs (5), formed by C-shaped profiles and joined together to form a prismatic contour (7), closed by the inner flat sides of all the plates, the plates comprising a means of mutual fixing and detachable means of immobilization. The means of mutual fixing are constituted by hinges (8), fixed to the edges of the plates, and by corresponding oblong orifices (9), evenly distributed on the plate (1) in transversal direction. The means of immobilization are constituted by a through hole (11) made in the shaft of each hinge (8) and by a sliding element (12) provided with a wedge-shaped end (13).

8 Claims, 2 Drawing Sheets

Fig. 1
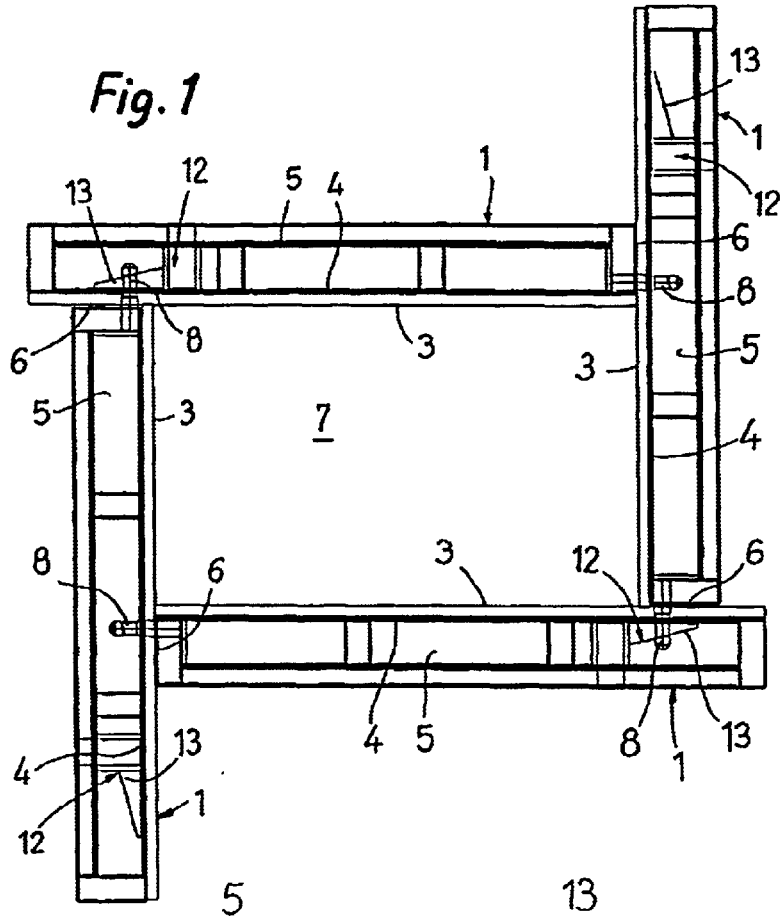
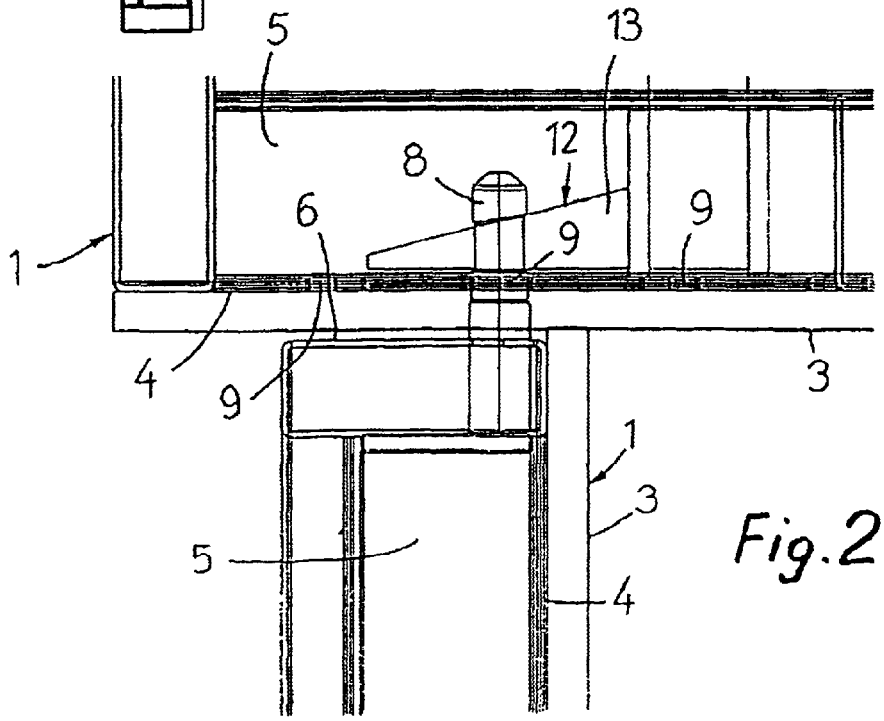
Fig. 2

FORMWORK FOR PILLARS

CROSS-REFERENCE TO RELATED APPLIATION

This Application is a Continuation of PCT/ES00/00130, filed Apr. 12, 2000, which was not published in English. The disclosure of PCT/ES00/00130 is incorporated herein by reference.

TECHNICAL SECTOR OF THE INVENTION

The present invention refers to formwork for pillars of the type constituted by several plates which are flat and rectangular, each of which consists of an inner flat side and an outer side provided with a transverse rib, formed by C-shaped profiles integral to the plate by its central span, the assembly position of the formwork being acquired when each of the plates is arranged with one of its longitudinal edges in even contact with an inner side of an adjoining plate, until it forms a prismatic contour closed by the inner flat sides of all the plates, each facing the other, which sets a hole intended to be taken up by the concrete of the pillar, the plates comprising a means of mutual fixing and detachable means of immobilization.

STATE OF THE ART

Multiple ways of carrying out formwork for pillars have been known for many years, amongst which it is possible to highlight Spanish utility model numbers 76.449, 95.410, 170.297, 170.326, U 8900526, U 9400013 and U 9500862, all of which refer to formwork particularly applicable to the construction of pillars.

In all of the embodiments described in the aforementioned models, plates, which are joined to each other by means of latches and pins, are used and these go through orifices and grooves of another plate which are fixed with tightening nuts and screws or by means of wedges inserted into the corresponding grooves.

Out of all of them, only utility model N° U 9500862 contemplates the possibility that the latches and pins, which are retractable, are inseparably joined to the corresponding plate.

In particular, Spanish utility model U 9500862 discloses a formwork for pillars, of the type constituted by several plates which are flat and rectangular, each of which consists of an inner flat side and an outer side provided with a transverse rib, formed by C-shaped profiles integral to the plate by its central span, the assembly position of the formwork being acquired when each of the plates is arranged with one of its longitudinal edges in even contact with an inner side of an adjoining plate, until it forms a prismatic contour, closed by the inner flat sides of all the plates, each facing the other, which sets a hole intended to be taken up by the concrete of the pillar, the plates comprising a means of mutual fixing and detachable means of immobilization, whereby the aforesaid means of mutual fixing are constituted by a longitudinal series of hinges, fixed to the edge of the plate intended to be in contact with the inner flat side of the adjoining plate, and by a corresponding longitudinal series of orifices, evenly distributed in transversal direction over the inner side, in such a way that the assembling of the formwork only requires to face the hinges of each plate to the corresponding orifices of each series of the adjoining plate and insert the hinges into the orifices.

The object of U 9500862 contributes the important advantage that it is impossible to lose them in successive utilizations of the plate. In spite of this, the object of said utility model N° U 9500862 shows certain drawbacks which make its application fairly annoying, such as, for example, the fact that the prior and individual adjustment of all the pins must be carried out when the plate is coupled to another adjoining one and that the pins have to be adjusted by means of a nut and subsequent tightening of same.

EXPLANATION OF THE INVENTION

All of the drawbacks mentioned, are completely eliminated in the formwork for pillars object of the present invention which is characterized in that the said orifices are oblong and in that the detachable means of mutual immobilization of the plates are constituted by a through hole made in the shaft of each hinge and by a sliding element provided with a wedge-shaped end arranged with the possibility of transversal movement and with adjustment in the inside of the "C"-shaped profiles, said means of immobilization being operative when the wedge of one of the plates is inserted in the hole of the hinge shaft of the adjoining plate, in such a way with that they prevent the unwanted separation of the plate with respect to the adjoining one.

The formwork object of the present invention also allows for a considerable reduction in the assembly time of formwork, by noticeably diminishing the coupling and fixing time of one plate to another, as it is not necessary to face the bolts one to one nor fix them with nuts. An additional advantage is also achieved which consists of the fact that the coupling parts, such as nuts or tightening spanners, cannot be lost either.

BRIEF DESCRIPTION OF THE DRAWINGS

In the enclosed drawings a form of embodiment of the formwork, object of the present invention, is illustrated by way of unrestrictive example.

FIG. 1 shows a cross-section view of the arrangement of four formwork plates in accordance with the invention, for the making of a pillar;

FIG. 2 is an enlarged, cross-section view in detail, of the fixing of one plate on another;

Figure 4:
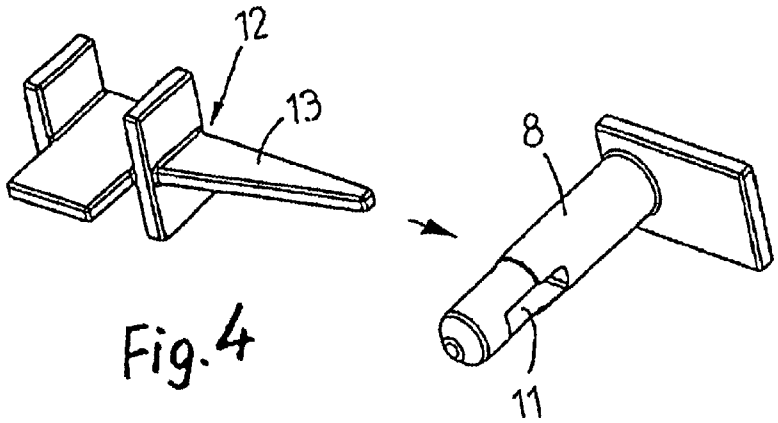
FIG. 4 shows an enlarged perspective view of a hinge and a corresponding sliding part, separated but in correlative fitting position.

In said drawings it can be appreciated that the formwork represented for pillars (10) is of the type constituted by several plates (1) flat and rectangular, each of which consists of an inner flat side (3) and an outer side (4) provided with transversal ribs (5). Preferably, said ribs (5) are constituted by "C"-shaped profiles supported by their central span to plate (1).

In this type of formwork the assembly position is acquired by arranging each of plates (1) with one of their longitudinal edges (6) in smooth contact with the inner side (3) of an adjoining plate (1), forming a prismatic contour (7) closed by the inner flat sides (3) of all the plates (1), facing each other. In such arrangement, the prismatic contour (7) creates a hole intended to be taken up by the concrete of pillar (10).

The plates (1) comprise the means of mutual fixing and detachable means of immobilization. Said means of mutual fixing are constituted by a longitudinal series of hinges (8), fixed to the edge (6) of the plate (1) intended to be in contact with the inner flat side (3) of the adjoining plate (1) and by a corresponding longitudinal series of oblong orifices (9), evenly distributed in transversal direction over plate (1). Each of the hinges (8) is fixed to the plate (1) with the result that the axle of its shaft is liable to oscillate lightly around the base of the hinge (8) for which the latter is fixed to the edge of the plate, thus achieving a certain amount of play of the hinge (8) which allows it to be inserted with much greater ease in the corresponding orifice (9) of the adjoining plate (1).

Therefore, for the assembly of the formwork, one only need face the hinges (8) of each of the plates (1) to a corresponding orifice (9) of each series of orifices of the adjoining plate (1), and insert the hinges (8) in the orifices (9).

Figure 5:
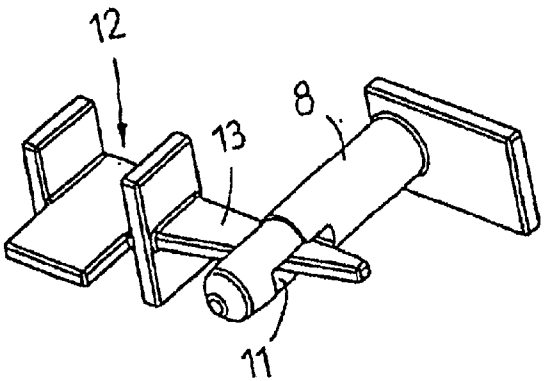
FIG. 5 shows a view similar to that of FIG. 4, but with the sliding part fitted into hinge 11.
Figure 3:
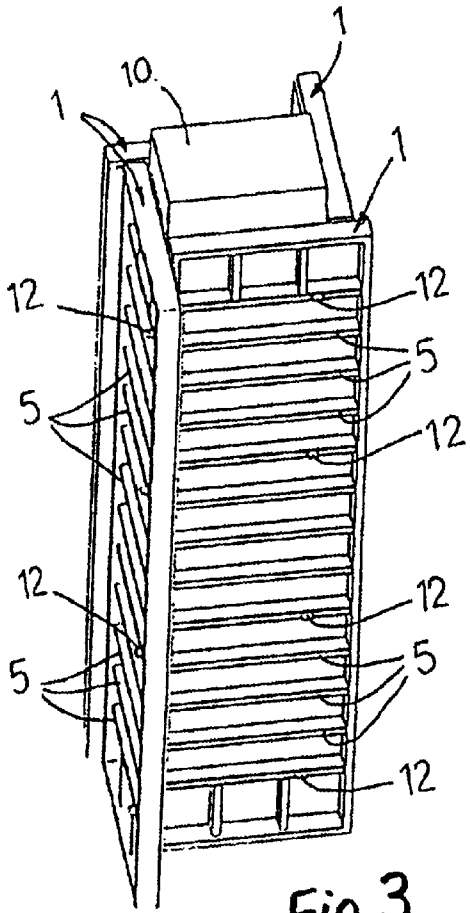
FIG. 3 illustrates a perspective view of the obtaining of a pillar by the utilization of the formwork plates object of the present invention.

The detachable means of mutual immobilization of the plates (1) are constituted by a through hole (11) made in the shaft of each hinge (8) and by a sliding element (12) provided with a wedge-shaped end (13), such as can be clearly appreciated in FIGS. 4 and 5 of the drawings. The sliding element (12) is arranged with the possibility of transversal movement and with adjustment in the inside of the "C"-shaped profiles (5).

The aforesaid means of immobilization work when the wedge (13) of one of the plates (1) is inserted in the hole (11) of the shaft of a hinge (8) of the adjoining plate (1), with the result that they prevent the unwanted separation of both plates.

What is claimed is:

1. A formwork for pillars comprising:

several plates which are flat and rectangular, each which consists of an inner flat side and an outer side provided with a transverse rib;

hinges, fixed to a longitudinal edge of each plate, each hinge including a shaft with a through hole; and sliding elements provided with wedge-shaped ends, that are capable of moving inside of the transverse ribs;

wherein each of the several plates is arranged with the longitudinal edge in contact with the inner flat side of another of the several plates to form a prismatic contour, closed by the inner flat sides of all the plates, which sets a hole capable of being filled with concrete, and wherein the plates are attached to each other by inserting the hinges of one of the several plates into the orifices of an other of the several plates and by sliding the sliding elements so that they are inserted in the holes of th hinge shafts.

2. The formwork of claim 1, wherein the orifices are oblong.

3. The formwork of claim 1, wherein the orifices are evenly distributed in a transverse direction over each plate.

4. The formwork of claim 1, wherein the hinges are cantilevered from the longitudinal edge of each plate.

5. A formwork for pillars comprising:

several plates which are flat and rectangular, each which consists of an inner flat side and an outer side;

hinges, fixed to a longitudinal edge of each plate, each hinge including a shaft with a through hole; and sliding elements provided with wedge-shaped ends;

wherein each of the plates is arranged with the longitudinal edge in contact with the inner flat side of another of the several plates to form a prismatic contour capable of being filled with concrete, and wherein the plates are attached to each other by inserting the hinges of one of the several plates into the orifices of an other of the several plates and by inserting the sliding elements into the holes of the hinge shafts.

6. The formwork of claim 5, wherein the orifices are oblong.

7. The formwork of claim 5, wherein the orifices are evenly distributed in a transverse direction over each plate.

8. The formwork of claim 5, wherein the hinges are cantilevered from the longitudinal edge of each plate.

* * * * *